US011245211B2

(12) United States Patent
Kitagawa

(10) Patent No.: US 11,245,211 B2
(45) Date of Patent: Feb. 8, 2022

(54) CONNECTOR HAVING AN ACTUATOR

(71) Applicant: KYOCERA CORPORATION, Kyoto (JP)

(72) Inventor: Naoki Kitagawa, Yokohama (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 16/975,569

(22) PCT Filed: Feb. 7, 2019

(86) PCT No.: PCT/JP2019/004484
§ 371 (c)(1),
(2) Date: Aug. 25, 2020

(87) PCT Pub. No.: WO2019/163539
PCT Pub. Date: Aug. 29, 2019

(65) Prior Publication Data

US 2020/0403339 A1 Dec. 24, 2020

(30) Foreign Application Priority Data

Feb. 26, 2018 (JP) ..... JP2018-032234

(51) Int. Cl.
*H01R 12/79* (2011.01)
*H01R 12/71* (2011.01)
(Continued)

(52) U.S. Cl.
CPC ..... *H01R 12/79* (2013.01); *H01R 12/71* (2013.01); *H01R 13/639* (2013.01); *H01R 13/64* (2013.01)

(58) Field of Classification Search
CPC ..... H01R 12/79; H01R 12/88; H01R 12/71; H01R 12/70; H01R 12/639; H01R 12/629; H01R 12/62; H01R 12/64
(Continued)

(56) References Cited

U.S. PATENT DOCUMENTS 6,790,074 B1 * 9/2004 Chiu ..... H01R 12/79 439/495
7,854,625 B1 * 12/2010 Yuan ..... H01R 12/88 439/495
(Continued)

FOREIGN PATENT DOCUMENTS

EP 2634866 A 9/2013
JP 2014-026765 A 2/2014
(Continued)

*Primary Examiner* — Harshad C Patel
(74) *Attorney, Agent, or Firm* — Duane Morris LLP

(57) ABSTRACT

A connector includes: an insulator that includes a first main surface being a surface that faces a cable, and a rear surface being a surface on an opposite side of the first main surface; a contact that electrically connects the cable and a substrate; and an actuator that is rotatable about a rotation axis parallel to the substrate. The actuator includes a plate-shaped side wall that intersects with the rotation axis. The side wall includes a base portion including a second main surface that is a surface that faces the first main surface when the actuator is rotated in a direction closer to the cable, and a recognition portion that protrudes from the base portion. A distance from the rotation axis to a leading end of the recognition portion in a direction orthogonal to the second main surface is larger than a distance from the rotation axis to the rear surface.

8 Claims, 12 Drawing Sheets

(51) Int. Cl.
*H01R 13/639* (2006.01)
*H01R 13/64* (2006.01)

(58) Field of Classification Search
USPC ..... 439/493
See application file for complete search history.

(56) References Cited

U.S. PATENT DOCUMENTS

| | | | | |
|---|---|---|---|---|
| 8,128,429 | B2 * | 3/2012 | Suzuki | H01R 12/707 439/493 |
| 8,845,358 | B2 * | 9/2014 | Kitagawa | H01R 12/774 439/357 |
| 8,851,914 | B2 * | 10/2014 | Lin | H01R 13/62933 439/260 |
| 9,160,101 | B2 * | 10/2015 | Takane | H01R 13/62 |
| 9,553,384 | B2 * | 1/2017 | Asanuma | H01R 12/88 |
| 9,680,244 | B1 * | 6/2017 | Dernovsek | H01R 12/716 |
| 9,793,629 | B2 * | 10/2017 | Tateishi | H01R 13/6273 |
| 10,566,721 | B2 * | 2/2020 | Nakajima | H01R 12/79 |
| 2006/0292911 | A1 | 12/2006 | Ning | |
| 2007/0010127 | A1 * | 1/2007 | Takahira | H01R 12/88 439/495 |
| 2007/0054529 | A1 * | 3/2007 | Harlan | H01R 12/88 439/260 |

FOREIGN PATENT DOCUMENTS

| | | | |
|---|---|---|---|
| JP | 2014026765 | A | 2/2014 |
| TW | M475719 | U | 4/2014 |

* cited by examiner

CONNECTOR HAVING AN ACTUATOR

CROSS-REFERENCE TO RELATED APPLICATION

This application claims the benefit of priority from Japanese Patent Application No. 2018-032234 filed on Feb. 26, 2018, the entire contents of which are incorporated herein by reference.

BACKGROUND

1. Technical Field

The present invention relates to a connector.

2. Description of the Related Art

Connectors are used to connect a flexible printed circuit (FPC), a flexible flat cable (FFC), or the like (hereinafter referred to as cable) to a substrate. Prior Art 1 describes an example of a connector. In a connector of Prior Art 1, a cable is prevented from falling out from a housing by covering a lug portion of the cable with a cover member rotatable with respect to the housing.

PRIOR ART

Prior Art 1: JP-A-2014-26765

SUMMARY

A connector according to an aspect includes: an insulator that includes a first main surface being a surface that faces a cable, and a rear surface being a surface on an opposite side of the first main surface; a contact that electrically connects the cable and a substrate; and an actuator that is rotatable about a rotation axis parallel to the substrate. The actuator includes a plate-shaped side wall that intersects with the rotation axis. The side wall includes: a base portion including a second main surface being a surface that faces the first main surface when the actuator is rotated in a direction closer to the cable; and a recognition portion that protrudes from the base portion. A distance from the rotation axis to a leading end of the recognition portion in a direction orthogonal to the second main surface is larger than a distance from the rotation axis to the rear surface.

DETAILED DESCRIPTION

Embodiments of a connector of the present disclosure will be described below with reference to the drawings. Embodiments are not intended to limit the invention. Moreover, components in embodiments below include ones easily replaceable by those skilled in the art, or ones substantially the same.

Embodiments

Figure 1:
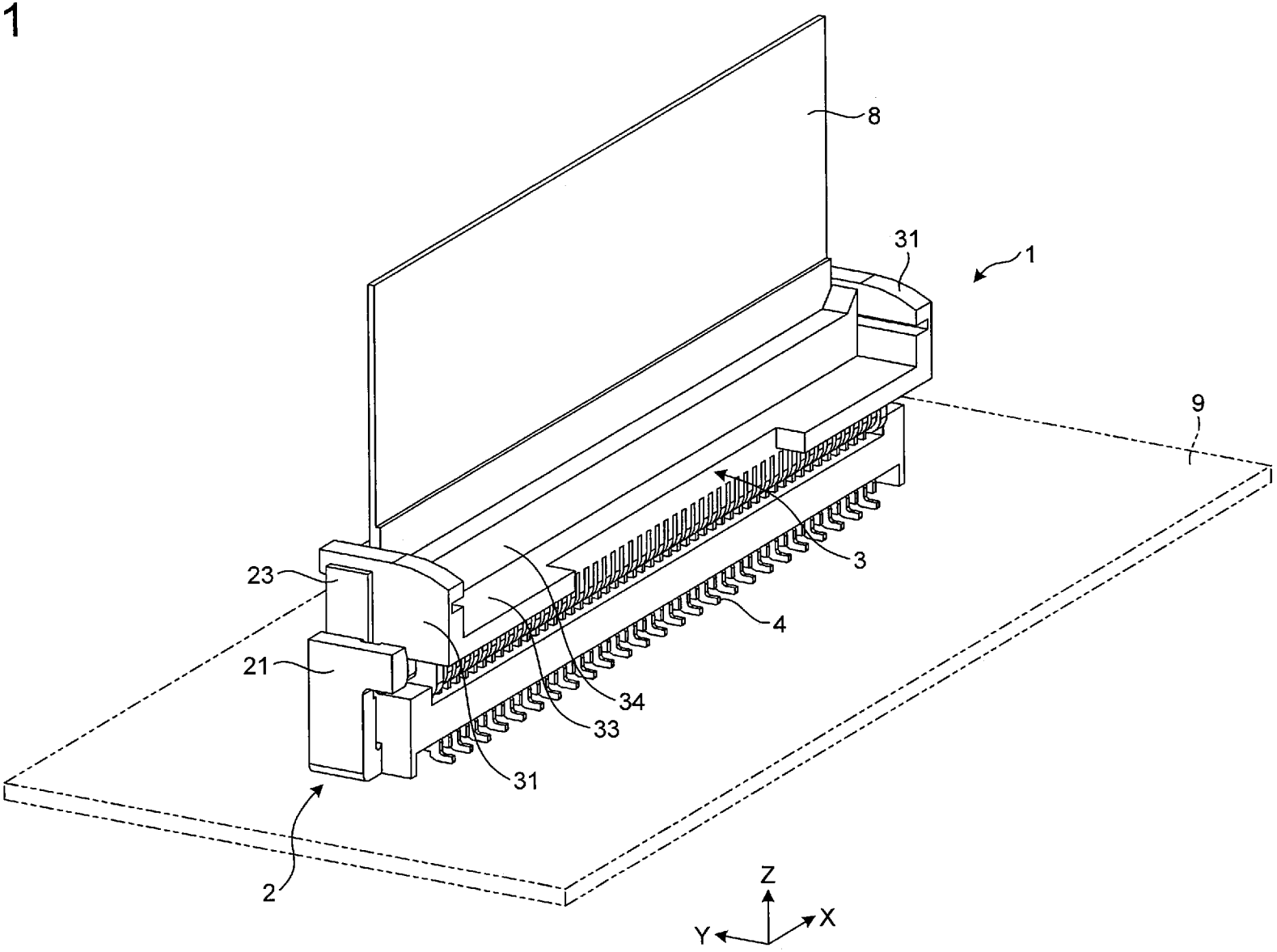
FIG. 1 is a perspective view of a connector and a cable according to embodiments.
Figure 2:
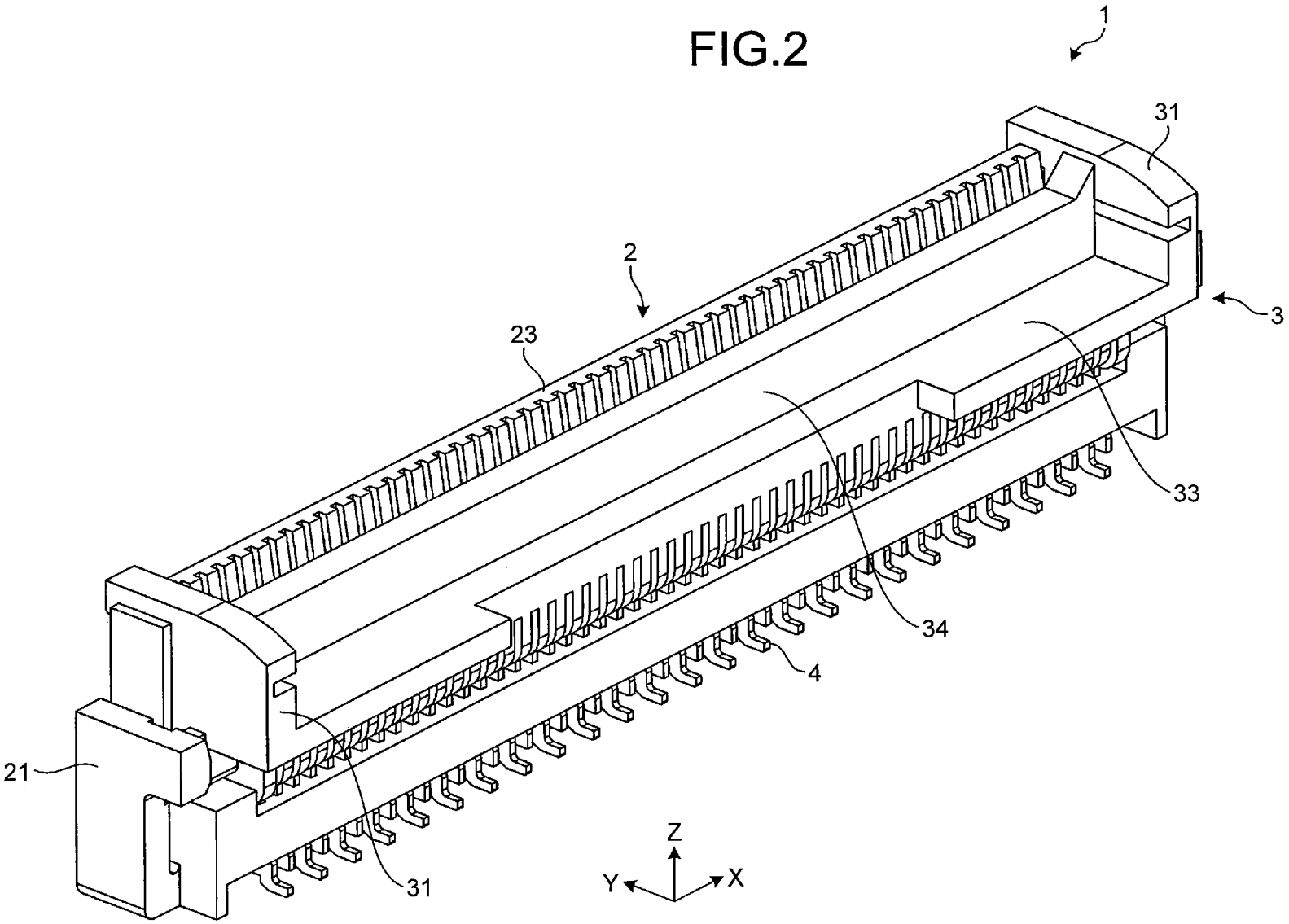
FIG. 2 is a perspective view of the connector according to embodiments.
Figure 3:
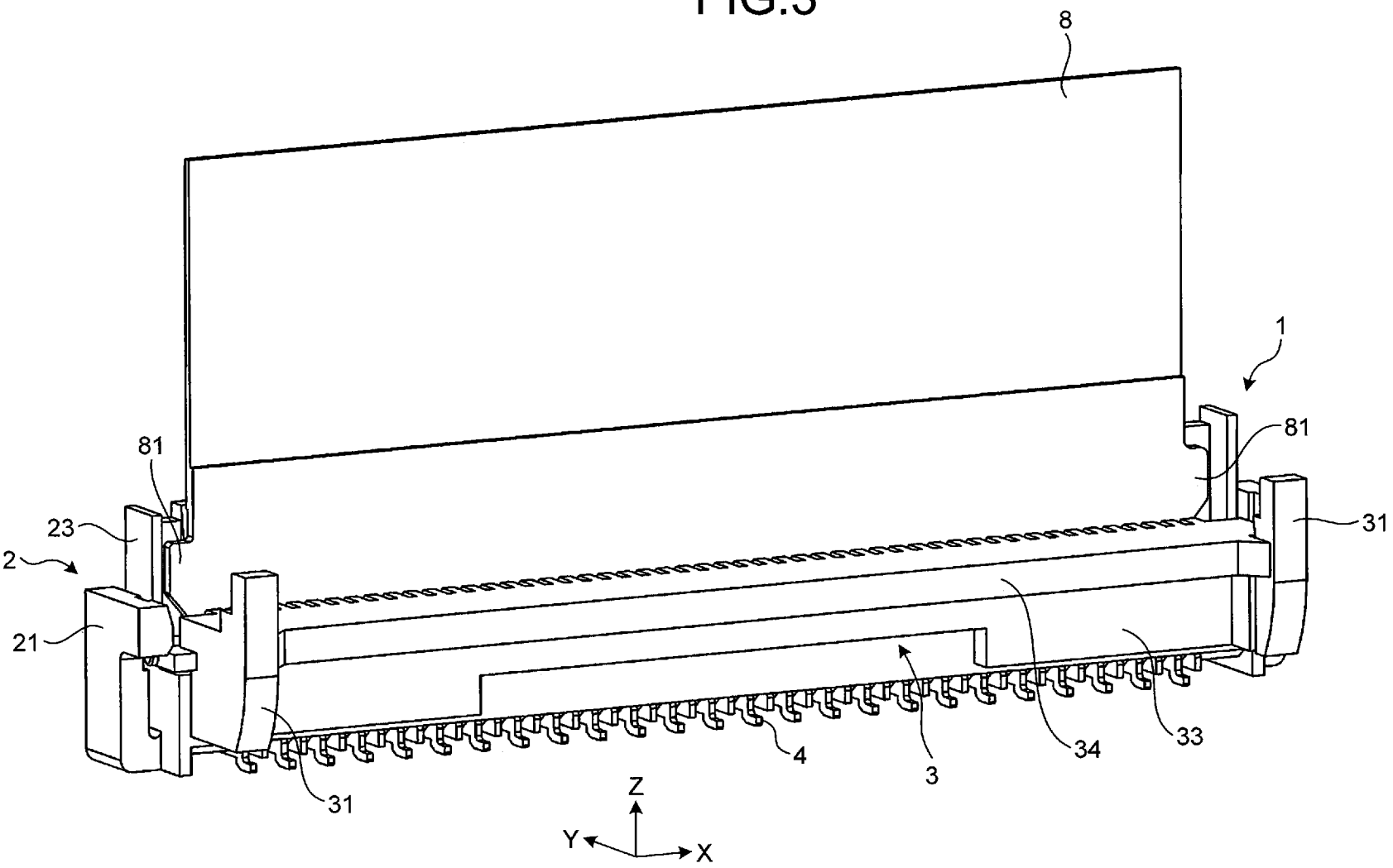
FIG. 3 is a perspective view of the connector and the cable according to embodiments.
Figure 4:
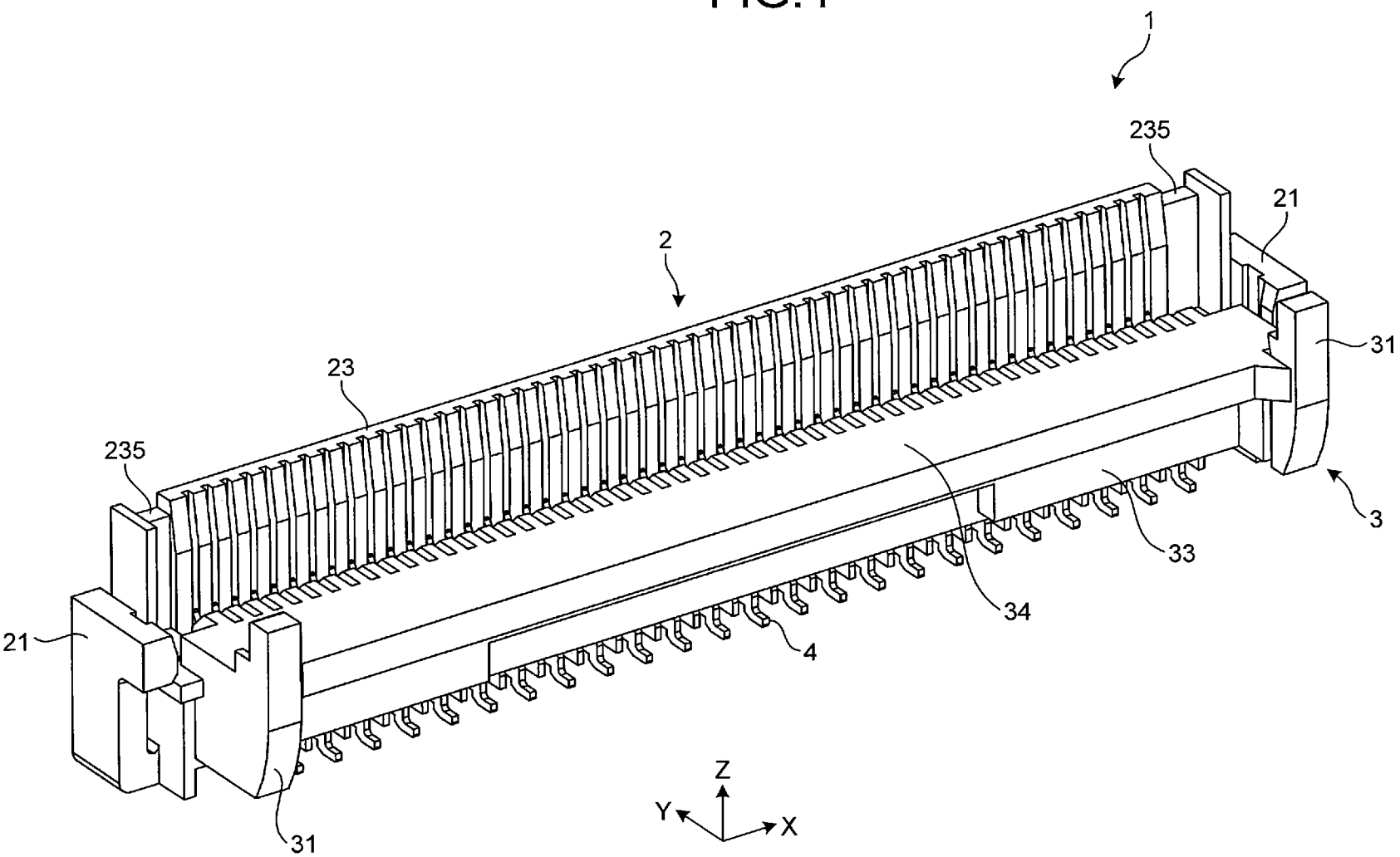
FIG. 4 is a perspective view of the connector according to embodiments.

FIG. 1 is a perspective view of a connector and a cable according to embodiments. FIG. 2 is a perspective view of the connector according to embodiments. FIG. 3 is a perspective view of the connector and the cable according to embodiments. FIG. 4 is a perspective view of the connector according to embodiments.

As illustrated in FIG. 1, a connector 1 according to embodiments is a device to connect a cable 8 and a substrate 9. The connector 1 is fixed to the substrate 9. The cable 8 is a flexible printed circuit (FPC), a flexible flat cable (FFC), or the like. The cable 8 is a flexible thin plate-shaped cable. The substrate 9 is a printed board, and includes a plurality of electronic parts.

In the following description, an XYZ Cartesian coordinate system is used. A Z-axis is orthogonal to the substrate 9. An X-axis is parallel to a longitudinal direction of the connector 1. A Y-axis is orthogonal to both the X-axis and the Z-axis. A direction along the X-axis is denoted as an X-direction, a direction along the Y-axis is denoted as a Y-direction, and a direction along the Z-axis is denoted as a Z-direction. Out of the Z-direction, a direction from the substrate 9 toward the connector 1 is denoted as a +Z-direction. Out of the Y-direction, a direction from the cable 8 toward an insulator 2, which will be described later, is denoted as a +Y-direction. A rightward direction when viewed in the +Y-direction with the +Z-direction being an upper direction is a +X-direction.

As illustrated in FIG. 2, a plurality of contacts 4, the insulator 2, and an actuator 3 are included. The contacts 4 are held by the insulator 2. The contacts 4 are arranged at predetermined intervals in the X-direction. The contacts 4 are fixed to the substrate 9. The contacts 4 hold the cable 8. The contacts 4 electrically connect the substrate 9 and the cable 8.

Figure 5:
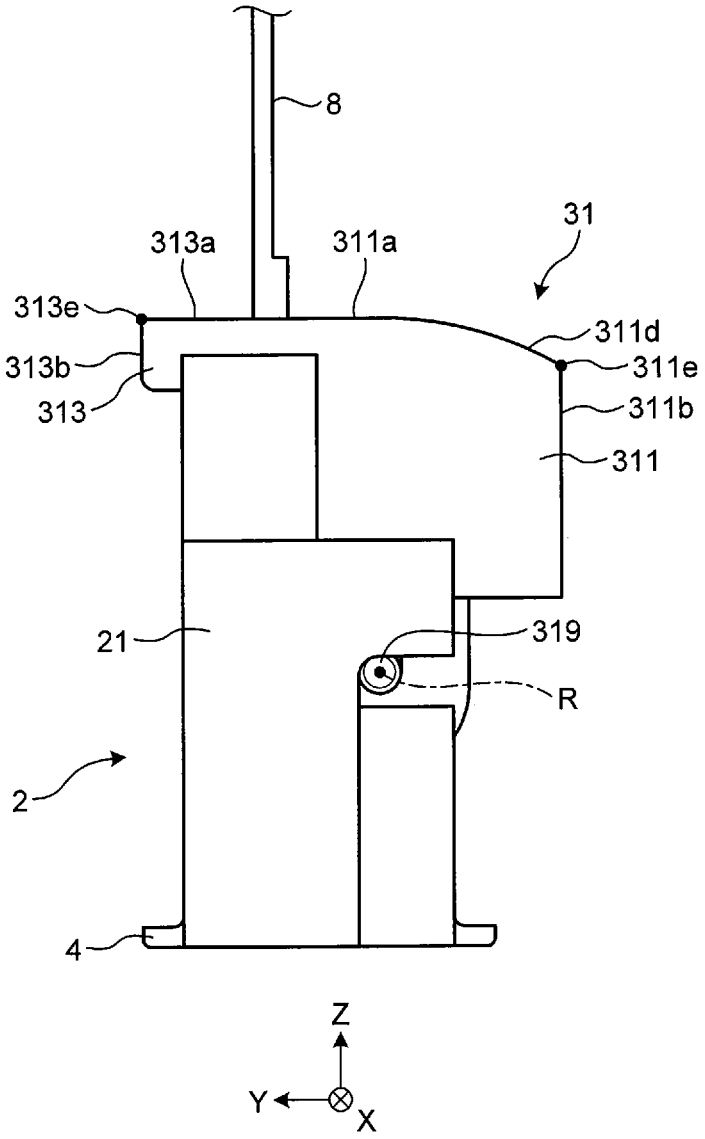
FIG. 5 is a left side view of the connector and the cable according to embodiments.
Figure 6:
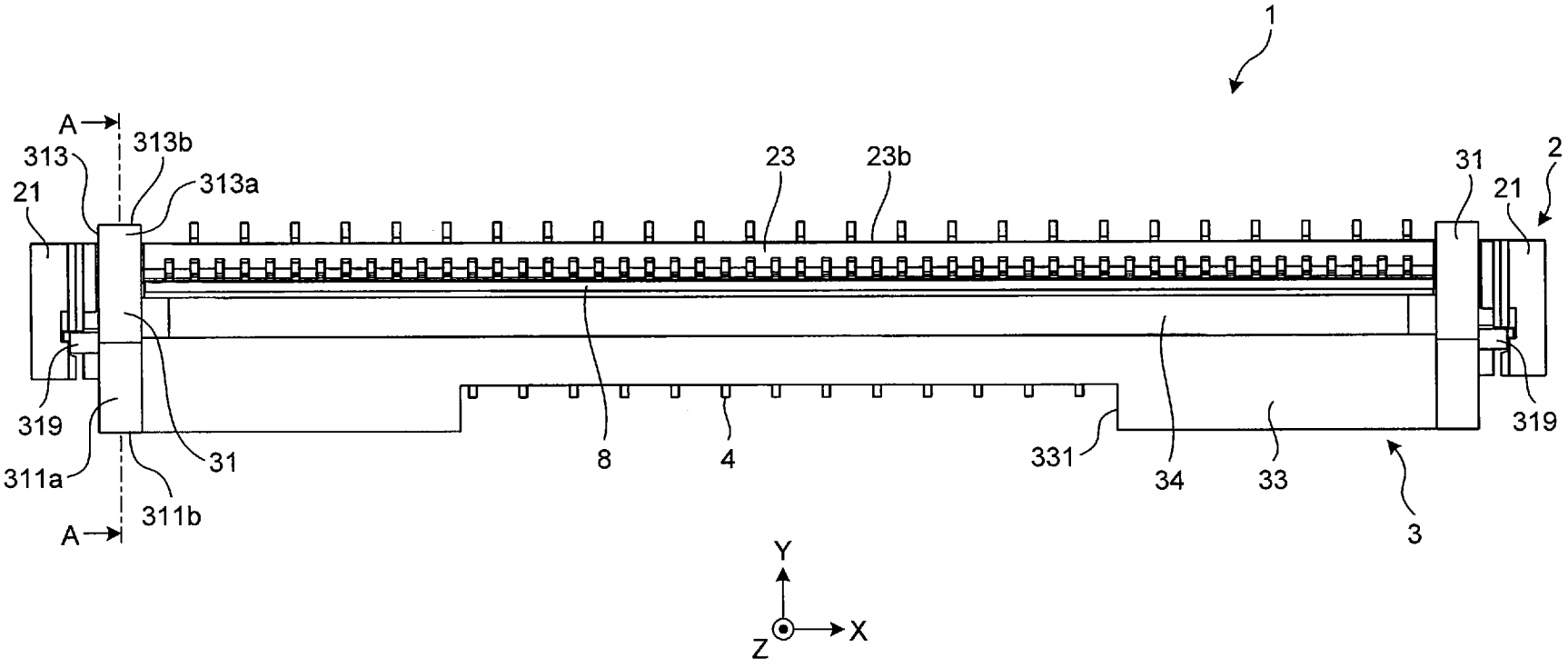
FIG. 6 is a plan view of the connector and the cable according to embodiments.
Figure 7:
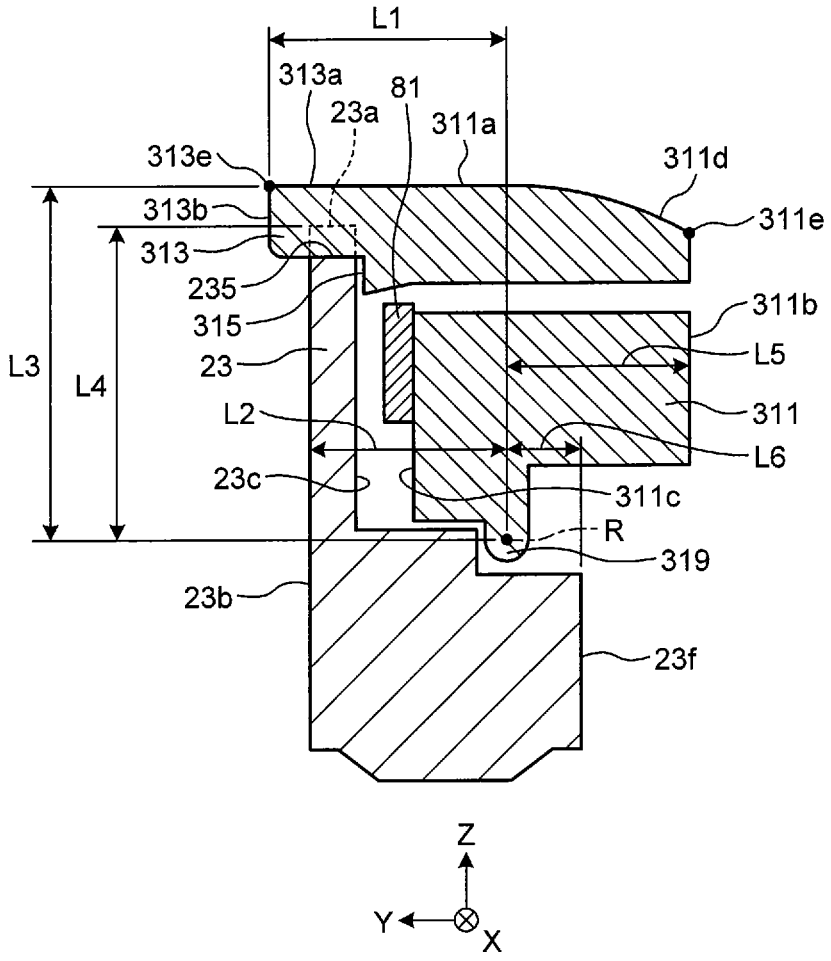
FIG. 7 is a sectional view of A-A in FIG. 6.

FIG. 5 is a left side view of the connector and the cable according to embodiments. FIG. 6 is a plan view of the connector and the cable according to embodiments. FIG. 7 is an A-A sectional view of FIG. 6.

As illustrated in FIG. 4, the insulator 2 includes two end walls 21 and a rear wall 23. The end wall 21 is a plate-shaped member orthogonal to the X-axis. The rear wall 23 is a plate-shaped member orthogonal to the Y-axis. The two end walls 21 are connected to the rear wall 23.

As illustrated in FIG. 7, the rear wall 23 includes an upper surface 23*a*, a first main surface 23*c*, a rear surface 23*b*, and a front surface 23*f*. The upper surface 23*a* is a surface that is orthogonal to the Z-axis, and that faces the +Z-direction. The first main surface 23*c* is a surface that is orthogonal to the Y-axis, and that faces a −Y-direction. The first main surface 23*c* is a surface facing the cable 8. The rear surfaced

23*b* is a surface that is orthogonal to the Y-axis, and that faces the +Y-direction. The rear surface 23*b* is a surface on the opposite side of the first main surface 23*c*. The front surface 23*f* is a surface that is orthogonal to the Y-axis, and that faces the −Y-direction. The front surface 23*f* is the farthest surface from the rear surface 23*b*. Moreover, as illustrated in FIG. 4 and FIG. 7, the rear wall 23 has two recessed portions 235. The recessed portion 235 is a groove arranged on the upper surface 23*a*.

The actuator 3 is attached to the insulator 2. The actuator 3 is rotatable with respect to the insulator 2. The actuator 3 rotates about a rotation axis R illustrated in FIG. 5. The rotation axis R is parallel to the X-axis. That is, the rotation axis R is parallel to the substrate 9.

As illustrated in FIG. 2, the actuator 3 includes two side walls 31, a first plate 33, and a second plate 34. The side wall 31 is a plate-shaped member orthogonal to the X-axis. The first plate 33 is a plate-shaped member orthogonal to the side wall 31. The second plate 34 is a plate-shaped member orthogonal to the side wall 31 and the first plate 33. The two side walls 31 are connected by the first plate 33 and the second plate 34. The first plate 33 and the second plate 34 increase the strength of the actuator 3.

The two side walls 31 are arranged at positions shifted from the contact 4 when viewed from the Z-direction. That is, the two side walls 31 do not overlap with the contact 4 in a plan view. The side wall 31 on the +X-direction side is positioned in the +X-direction with respect to the contact 4 positioned at an end portion on the +X-direction side out of the plurality of contacts 4. The side wall 31 on the −X-direction side is positioned in the −X-direction with respect to the contact 4 positioned at an end portion on the −X-direction side out of the plurality of contacts 4.

As illustrated in FIG. 5 and FIG. 7, the side wall 31 includes a base portion 311, a shaft 319, a recognition portion 313, and a raised portion 315. As illustrated in FIG. 7, the base portion 311 includes an upper surface 311*a*, a second main surface 311*c*, a second end surface 311*b*, a curved surface 311*d*, and a second ridge 311*e*. The second main surface 311*c* is a surface that faces the first main surface 23*c* when the actuator 3 is rotated in a direction closer to the cable 8. The second end surface 311*b* is a surface positioned on the opposite side of the second main surface 311*c*. The second end surface 311*b* is parallel to the second main surface 311*c*. The curved surface 311*d* connects the second end surface 311*b* and the upper surface 311*a*. The curved surface 311*d* forms an arc about the rotation axis R when viewed from the X-direction. The second ridge 311*e* is formed at a position at which the curved surface 311*d* and the second end surface 311*b* intersect with each other. That is, the second ridge 311*e* is positioned at an end portion of the curved surface 311*d* and an end portion of the second end surface 311*b*.

In the following description, a state in which the second main surface 311*c* is parallel to the first main surface 23*c* is described as a first state. A state in which the second main surface 311*c* is orthogonal to the first main surface 23*c* is described as a second state. FIG. 1, FIG. 2, and FIG. 5 to FIG. 7 illustrate the first state. The first state can also be described as a state in which the actuator 3 is closed. FIG. 3 and FIG. 4 illustrate the second state. The second state can also be described as a state in which the actuator 3 is open. In the second state, the cable 8 can be inserted between the insulator 2 and the actuator 3. After the cable 8 is inserted between the insulator 2 and the actuator 3, the actuator 3 is rotated in the direction closer to the cable 8. When the actuator 3 is rotated to a predetermined position, the actuator 3 is positioned by a lock mechanism provided in the insulator 2.

As illustrated in FIG. 7, in the first state, the upper surface 311*a* of the base portion 311 is orthogonal to the Z-axis, and faces the +Z-direction. In the first state, the second main surface 311*c* of the base portion 311 is orthogonal to the Y-axis, and faces the +Y-direction. In the first state, the second main surface 311*c* faces a lug portion 81 of the cable 8. In the first state, the second end surface 311*b* of the base portion 311 is orthogonal to the Y-axis and faces the −Y-direction. In the first state, the second ridge 311*e* is positioned at an end portion in the −Y-direction in the side wall 31.

As illustrated in FIG. 7, a distance L5 is larger than a distance L6. The distance L5 is a distance from the rotation axis R to the second end surface 311*b* in a direction orthogonal to the second main surface 311*c* (Y-direction in the first state illustrated in FIG. 7). The distance L6 is a distance from the rotation axis R to the front surface 23*f*.

As illustrated in FIG. 6, the shaft 319 protrudes from the base portion 311 in the X-direction. The shaft 319 is attached to the end wall 21 of the insulator 2. The actuator 3 rotates about the shaft 319. The rotation axis R is a straight line passing through the center of a sectional view of the shaft 319 cut along a plane orthogonal to the X-axis.

As illustrated in FIG. 7, the recognition portion 313 protrudes from the base portion 311 in a direction orthogonal to the second main surface 311*c*. As illustrated in FIG. 7, in the first state, the recognition portion 313 protrudes from the base portion 311 in the +Y-direction. In the first state, the recognition portion 313 is positioned in the +Y-direction with respect to the first main surface 23*c* of the insulator 2, and engages with the recessed portion 235. In the first state, the recognition portion 313 protrudes from the rear surface 23*b* of the insulator 2 in the +Y-direction.

As illustrated in FIG. 7, the recognition portion 313 includes an upper surface 313*a*, a first end surface 313*b*, and a first ridge 313*e*. The upper surface 313*a* is a surface on the opposite side of the rear wall 23 of the insulator 2, and has a planar shape. The upper surface 313*a* is continuous to the upper surface 311*a* of the base portion 311. The first end surface 313*b* is a surface that is the farthest from the rotation axis R in a direction orthogonal to the second main surface 311*c*. An angle formed by the upper surface 313*a* and the first end surface 313*b* is 90°. The first ridge 313*e* is formed at a position at which the upper surface 313*a* and the first end surface 313*b* intersect with each other. That is, the first ridge 313*e* is positioned at an end portion of the upper surface 313*a* and an end portion of the first end surface 313*b*. A distance from the second end surface 311*b* to the first end surface 313*b* (length of the side wall 31 in the Y-direction in the first state) is larger than a length of the end wall 21 of the insulator 2 in the Y-direction. A distance from the second end surface 311*b* to the first end surface 313*b* is preferably as large as possible.

As illustrated in FIG. 7, in the first state, the upper surface 313*a* is orthogonal to the Z-axis and faces the +Z-direction. In the first state, the first end surface 313*b* is orthogonal to the Y axis and faces the +Y-direction. In the first state, the first ridge 313*e* is positioned at an end portion in the +Y-direction in the side wall 31.

As illustrated in FIG. 7, a distance L1 is larger than a distance L2. The distance L1 is a distance from the rotation axis R to a leading end of the recognition portion 313 (first end surface 313*b*) in a direction orthogonal to the second main surface 311*c* (Y-direction in the first state illustrated in FIG. 7). The distance L2 is a distance from the rotation axis R to the rear surface 23*b*.

As illustrated in FIG. 7, the upper surface 313*a* of the recognition portion 313 is shifted to the Z-direction with respect to the upper surface 23*a* of the insulator 2. As illustrated in FIG. 7, a distance L3 is larger than a distance L4. The distance L3 is a distance from the rotation axis R to a leading end of the recognition portion 313 (upper surface 313*a*) in a direction that is orthogonal to the rotation axis R and parallel to the second main surface 311*c* (Z-direction in the first state illustrated in FIG. 7). The distance L4 is a distance from the rotation axis R to the upper surface 23*a* of the rear wall 23 in a direction orthogonal to the rotation axis R and parallel to the rear surface 23*b* (Z-direction in the first state illustrated in FIG. 7).

As illustrated in FIG. 7, the raised portion 315 protrudes from the base portion 311 in a direction orthogonal to the second main surface 311*c*. In the first state, the raised portion 315 is positioned in the −Y-direction with respect to the first main surface 23*c* of the insulator 2, and is positioned in the −Z-direction with respect to the recessed portion 235. In the first state, the raised portion 315 faces the first main surface 23*c* with a gap therebetween. In the first state, the raised portion 315 covers the +Z-direction side of the lug portion 81 of the cable 8. Thus, the cable 8 is prevented from falling off.

As illustrated in FIG. 2, the first plate 33 is a member that extends from one side wall 31 to the other side wall 31. The first plate 33 has a plate shape orthogonal to the second main surface 311*c*. In the first state, the first plate 33 has the plate shape orthogonal to the Z-axis. As illustrated in FIG. 6, the first plate 33 has a notch 331. The notch 331 overlaps with at least one of the contacts 4 in the Z-direction in the first state. Thus, it becomes possible to check a mounting state of the contacts 4 from the Z-direction.

The second plate 34 is a member that extends from one side wall 31 to the other side wall 31. The second plate 34 has a plate shape orthogonal to the first plate 33. In the first state, the second plate 34 has the plate shape orthogonal to the Y-axis. The first plate 33 and the second plate 34 increase the strength of the actuator 3.

Figure 8:
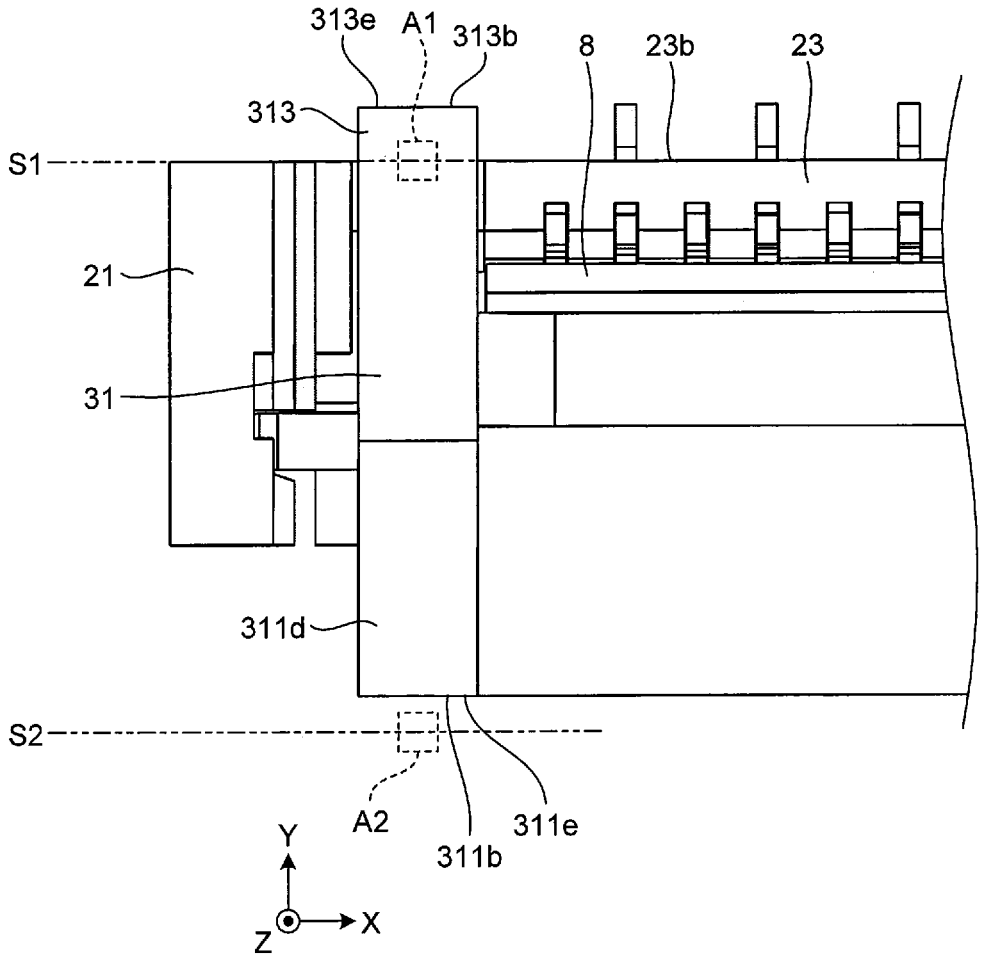
FIG. 8 is a plan view of a side wall in a state where an actuator is properly closed.
Figure 9:
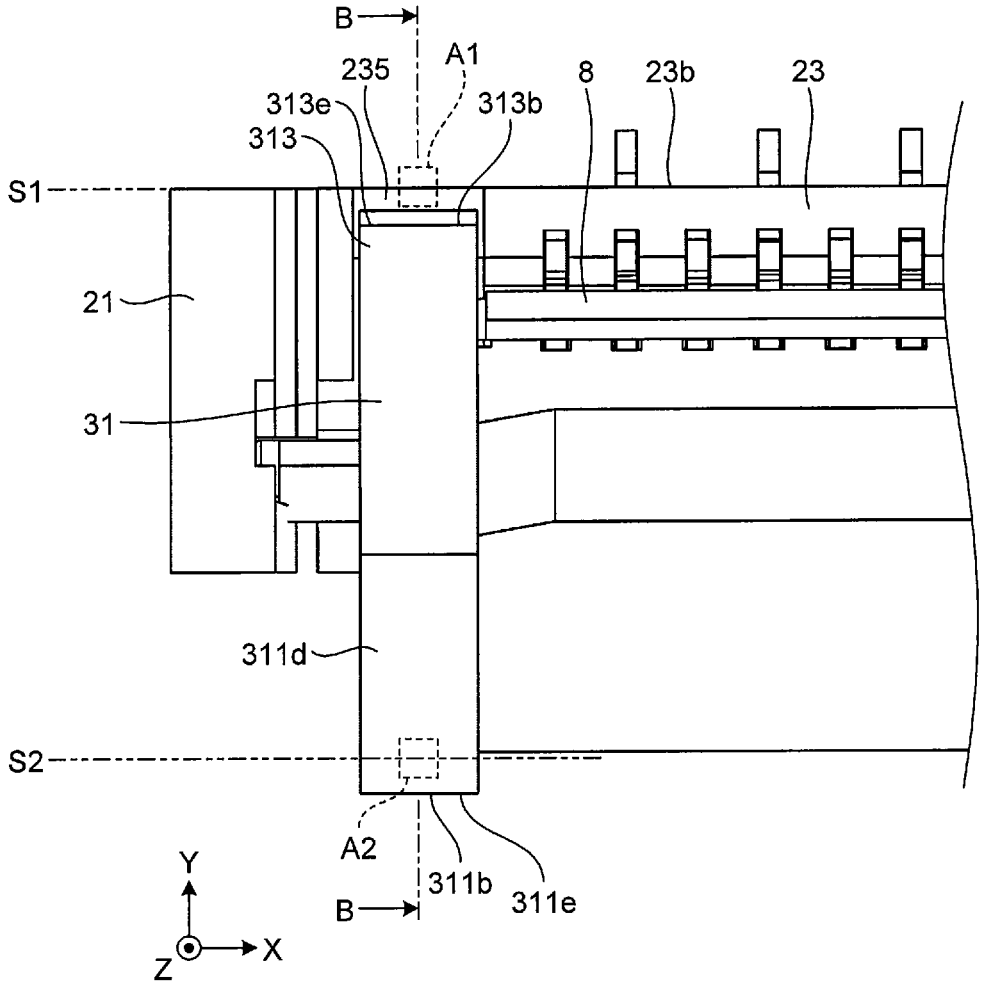
FIG. 9 is a plan view of the side wall in a state where the actuator is not properly closed.
Figure 10:
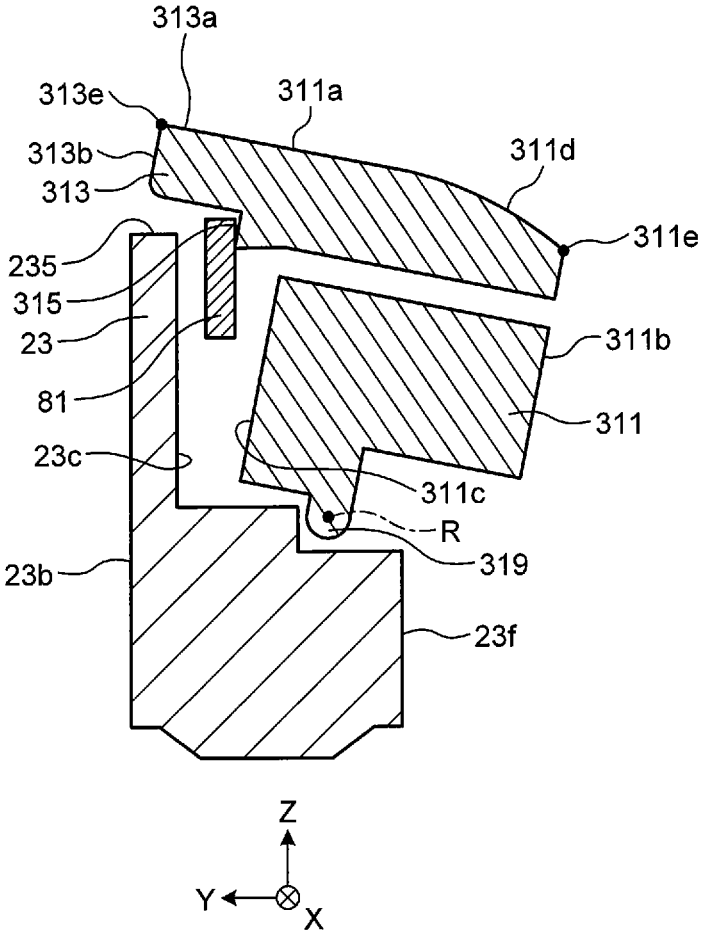
FIG. 10 is a sectional view of B-B in FIG. 9.

FIG. 8 is a plan view of a side wall in which the actuator is properly closed. FIG. 9 is a plan view of the side wall in a state in which the actuator is not properly closed. FIG. 10 is a B-B sectional view of FIG. 9. FIG. 1 and FIG. 5 to FIG. 8 illustrate the state in which the actuator 3 is properly closed. The state in which the actuator 3 is properly closed is a state in which the raised portion 315 of the side wall 31 is positioned in the +Z-direction with respect to the lug portion 81 of the cable 8 as illustrated in FIG. 7. The state in which the actuator 3 is not properly closed is a state in which the raised portion 315 overrides the lug portion 81 in the −Y-direction as illustrated in FIG. 10.

When the cable 8 is not arranged at a proper position, there is a case in which the actuator 3 is not closed properly because of an interference between the actuator 3 and the lug portion 81 of the cable 8, or the like. The actuator 3 not properly closed is necessary to be detected by product inspection or the like. Therefore, in the connector 1, it is preferable that whether the actuator 3 is properly closed can be easily detected by inspection.

When the cable 8 is arranged at a proper position, as illustrated in FIG. 7, the raised portion 315 of the side wall 31 is positioned in the +Z-direction with respect to the lug portion 81 of the cable 8. In this case, the second main surface 311*c* is parallel to the first main surface 23*c*. Therefore, as illustrated in FIG. 8, the recognition portion 313 protrudes from the rear surface 23*b* of the insulator 2 in the +Y-direction.

On the other hand, when the cable 8 is not arranged in a proper position, the raised portion 315 of the side wall 31 interferes with the lug portion 81 of the cable 8. That is, the raised portion 315 overrides the lug portion 81 in the −Y-direction. In this case, the second main surface 311*c* is not parallel to the first main surface 23*c*. Therefore, for example, as illustrated in FIG. 9, the recognition portion 313 does not protrude from the rear surface 23*b* of the insulator 2. Even if the recognition portion 313 protrudes from the rear surface 23*b* in the +Y-direction, an amount of protrusion is small compared to the case in FIG. 8.

Production inspection to determine whether the cable 8 is properly connected is performed with respect to the connector 1 to which the cable 8 is connected. The connector 1 is automatically inspected by an inspection device. The inspection device is, for example, an automated optical inspection (AOI). The inspection device scans the connector 1 from the +Z-direction with a camera.

The inspection device determines whether the cable 8 is properly connected based on a position of the recognition portion 313. For example, the inspection device detects a position of the first ridge 313*e* of the recognition portion 313 with respect to a predetermined reference line S1 as illustrated in FIG. 8 and FIG. 9. The reference line S1 is, for example, a straight line that coincides with the rear surface 23*b* of the insulator 2. As illustrated in FIG. 8, when the first ridge 313*e* is positioned in the +Y-direction with respect to the reference line S, the inspection device determines that the cable 8 is properly connected. As illustrated in FIG. 9, when the first ridge 313*e* is positioned in the −Y-direction with respect to the reference line S1, the inspection device determines that the cable 8 is not properly connected.

The reference line S1 is not necessarily a straight line that coincides with the rear surface 23*b*. The position of the reference line S1 is not particularly limited. Moreover, the inspection device may detect an amount of protrusion of the recognition portion 313 from the reference line S1. The inspection device may determine whether the cable 8 is properly connected based on the area of the recognition portion 313 that occupies a freely-selected region A1 as illustrated in FIG. 8 and FIG. 9.

The inspection device determines whether the cable 8 is properly connected based on a position of the base portion 311. For example, the inspection device detects a position of the second ridge 311*e* of the base portion 311 with respect to a predetermined reference line S2 as illustrated in FIG. 8 and FIG. 9. As illustrated in FIG. 8, when the second ridge 311*e* is positioned in the +Y-direction with respect to the reference line S2, the inspection device determines that the cable 8 is properly connected. AS illustrated in FIG. 9, when the second ridge 311*e* is positioned in the Y-direction with respect to the reference line S2, the inspection device determines that the cable 8 is not properly connected.

The position of the reference line S2 is not particularly limited. Moreover, the inspection device may detect an amount of protrusion of the base portion 311 from the reference line S2. The inspection device may determine whether the cable 8 is properly connected based on the area of the base portion 311 occupying a freely-selected region A2 as illustrated in FIG. 8 and FIG. 9.

The insulator 2 does not necessarily include the recessed portion 235. However, the insulator 2 preferably includes the recessed portion 235 in light of the recessed portion 235 making the recognition portion 313 unlikely to be shifted from a predetermined position in the X-direction. Positioning of the recognition portion 313 by the recessed portion 235 improves accuracy in determination of the inspection device.

In the base portion 311 of the actuator 3, the second end surface 311*b* is not necessarily parallel to the second main surface 311*c* as long as an angle formed by the second end surface 311*b* and the upper surface 311*a* is 90° or less. In the recognition portion 313, an angle formed by the upper surface 313*a* and the first end surface 313*b* is not necessarily 90°, and is only required to be 90° or less.

The two side walls 31 may overlap with the contacts 4 in a plan view. However, the two side walls 31 preferably do not overlap with the contacts 4 in a plan view in light of easiness to check a mounting state of the contacts 4.

The connector 1 may include an elastic member that pushes the actuator 3 to a direction away from the insulator 2. The elastic member is, for example, a spring made of a metal.

As described above, the connector 1 includes the insulator 2, the contacts 4, and the actuator 3. The insulator 2 includes the first main surface 23*c* that is a surface facing the cable 8, and the rear surface 23*b* that is a surface on the opposite side of the first main surface 23*c*. The contacts 4 electrically connect the cable 8 and the substrate 9. The actuator 3 is rotatable about the rotation axis R that is parallel to the substrate 9. The actuator 3 includes the side wall 31 having a plate shape intersecting the rotation axis R. The side wall 31 includes: the base portion 311 having the second main surface 311*c* that is a surface that faces the first main surface 23*c* when the actuator 3 is rotated in a direction closer to the cable 8; and the recognition portion 313 that protrudes from the base portion 311. The distance L1 from the rotation axis R to the leading end of the recognition portion 313 (the first end surface 313*b*) in a direction orthogonal to the second main surface 311*c* is larger than the distance L2 from the rotation axis R to the rear surface 23*b*.

Thus, if the actuator 3 is properly closed, the recognition portion 313 protrudes from the insulator 2 in a plan view. On the other hand, if the actuator 3 is not properly closed, the recognition portion 313 does not protrude from the insulator 2, or the amount of protrusion of the recognition portion 313 is small. Therefore, with the connector 1, it is possible to easily determine whether the actuator 3 is properly closed by inspection.

In the connector 1, the distance L3 from the rotation axis R to the leading end of the recognition portion 313 (upper surface 313*a*) in the direction orthogonal to the rotation axis R and parallel to the second main surface 311*c* is different from the distance L4 from the rotation axis R to the upper surface 23*a* of the insulator 2 in the direction orthogonal to the rotation axis R and parallel to the rear surface 23*b*. Thus, it becomes possible to bring a camera of an inspection device into focus on the recognition portion 313, and shift the recognition portion 313 from of the upper surface 23*a* of the insulator 2. Therefore, it is possible to prevent the inspection device from falsely recognizing the upper surface 23*a* of the insulator 2 as the recognition portion 313.

In the connector 1, the distance L3 from the rotation axis R to the leading end of the recognition portion 313 (upper surface 313*a*) in the direction orthogonal to the rotation axis R and parallel to the second main surface 311*c* is larger than the distance L4 from the rotation axis R to the upper surface 23*a* of the insulator 2 in the direction orthogonal to the rotation axis R and parallel to the rear surface 23*b*. Thus, the distance from the rotation axis R to the recognition portion 313 becomes large. This makes the displacement of the recognition portion 313 likely to be large if the actuator 3 is not properly closed. Consequently, with the connector 1, the inspection to determine whether the actuator 3 is properly closed becomes easier.

In the connector 1, the recognition portion 313 includes: the first end surface 313*b* that is the farthest surface from the rotation axis R in the direction orthogonal to the second main surface 311*c*; and the first ridge 313*e* that is positioned at an end portion of the first end surface 313*b*. Thus, the position of the leading end of the recognition portion 313 becomes clear in a plan view. Therefore, with the connector 1, the inspection to determine whether the actuator 3 is properly closed becomes easier.

In the connector 1, the recognition portion 313 includes the upper surface 313*a* that is a surface on the opposite side of the insulator 2 and that has a planar shape. This makes reflection of light emitted from the inspection device on the recognition portion 313 more likely to be uniform. Therefore, with the connector 1, the inspection to determine whether the actuator 3 is properly closed becomes easier.

In the connector 1, the insulator 2 includes: the front surface 23*f* that is the farthest surface from the rear surface 23*b*. The base portion 311 includes the second end surface 311*b* that is a surface positioned on the opposite side of the second main surface 311*c* with respect to the rotation axis R. The distance L5 from the rotation axis R to the second end surface 311*b* in the direction orthogonal to the second main surface 311*c* is larger than the distance L6 from the rotation axis R to the front surface 23*f*.

In other words, it is as described below. The connector 1 includes the insulator 2, the contacts 4, and the actuator 3. The insulator 2 includes the first main surface 23*c* that is a surface facing the cable 8, the rear surface 23*b* that is a surface on the opposite side of the first main surface 23*c*, and the front surface 23*f* that is the farthest surface from the rear surface 23*b*. The contacts 4 electrically connect the cable 8 and the substrate 9. The actuator 3 is rotatable about the rotation axis R that is parallel to the substrate 9. The actuator 3 includes the side walls 31 in a plate-shape that intersect with the rotation axis R. The side wall 31 includes: the second main surface 311*c* that is a surface that faces the first main surface 23*c* when the actuator 3 is rotated in a direction closer to the cable 8; and the second end surface 311*b* that is a surface positioned on the opposite side of the second main surface 311*c* with respect to the rotation axis R. The distance L5 from the rotation axis R to the second end surface 311*b* in the direction orthogonal to the second main surface 311*c* is larger than the distance L6 from the rotation axis R to the front surface 23*f*.

Thus, if the actuator 3 is properly closed, the base portion 311 protrudes from the insulator 2 in a plan view. On the other hand, if the actuator 3 is not properly closed, the base portion 311 does not protrude from the insulator 2 in a plan view, or the amount of protrusion of the recognition portion 313 becomes small. Therefore, with the connector 1, the inspection to determine whether the actuator 3 is properly closed becomes easier.

In the connector 1, the base portion 311 includes the second ridge 311*e* that is positioned at an end portion of the second end surface 311*b*. Thus, the position of the leading end of the base portion 311 becomes clear in a plan view. Therefore, with the connector 1, the inspection to determine whether the actuator 3 is properly closed becomes easier.

In the connector 1, the base portion 311 includes the curved surface 311*d* that is continuous to the second end surface 311*b*. The curved surface 311*d* forms an arc about the rotation axis R when viewed from a direction parallel to the rotation axis R. This makes reflection of light emitted from the inspection device on the curved surface 311*d* uniform regardless of a rotation angle of the actuator 3. Thus, with the connector 1, the inspection to determine whether the actuator 3 is properly closed becomes easier. Moreover, it is preferable that a focus position of the camera of the inspection device be fixed. For example, when part of the curved surface 311*d* is imaged by the camera, a position from the camera to a portion to be imaged becomes fixed because of the curved surface 311*d* being an arc about the rotation axis R even if the actuator 3 is inclined to some extent. Consequently, even though the focus position of the camera is fixed, an image taken thereby is more likely to be clear. This improves accuracy in inspection to determine whether the actuator 3 is properly closed.

Embodiments of the present disclosure can be modified within a range not departing from the gist and the scope of the invention. Furthermore, embodiments and modifications of the present disclosure can be appropriately combined. For example, the embodiment described above may be modified as follows.

Figure 11:
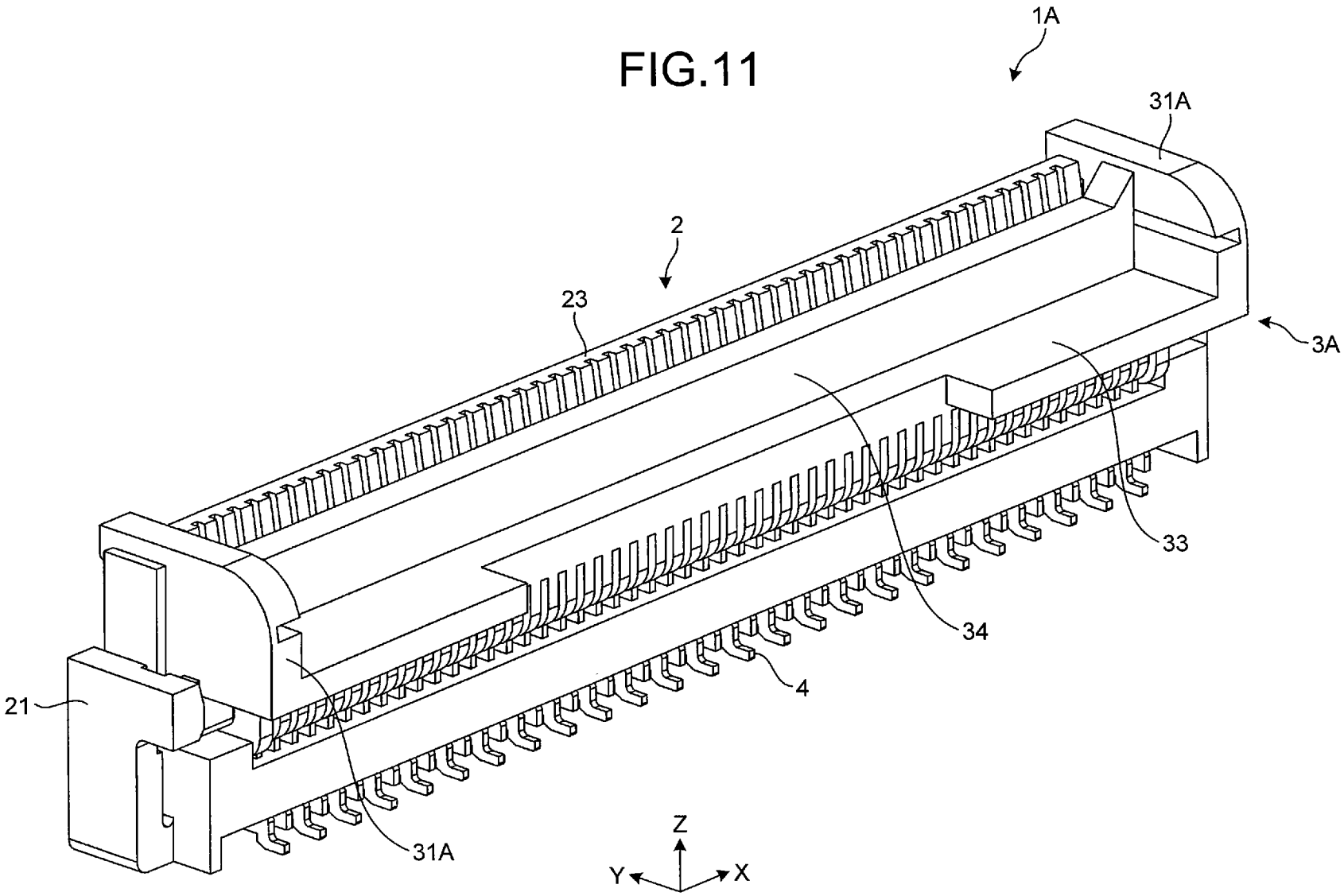
FIG. 11 is a perspective view of a connector according to a modification.
Figure 12:
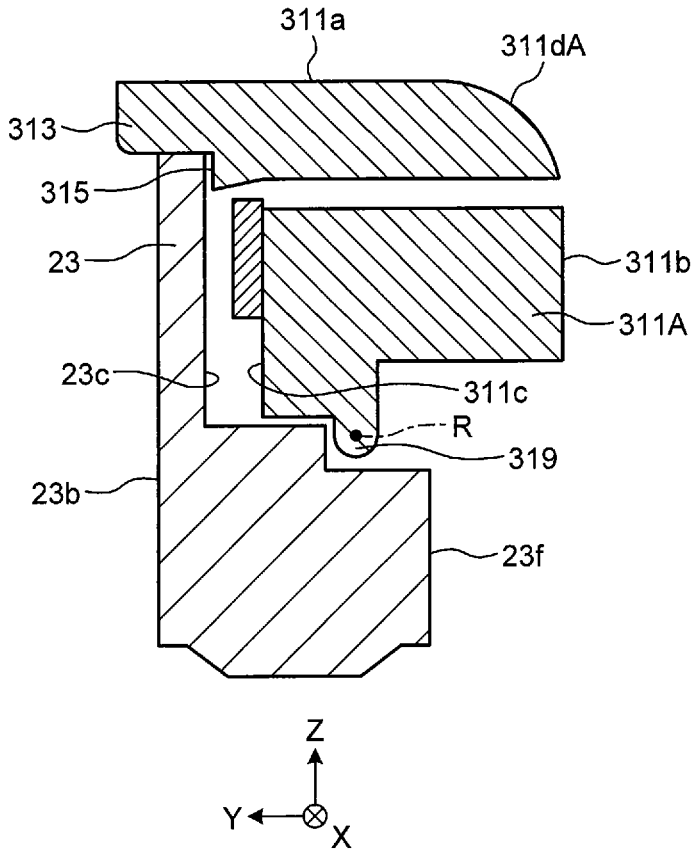
FIG. 12 is a sectional view of the connector according to the modification.

FIG. 11 is a perspective view of a connector according to a modification. FIG. 12 is a sectional view of the connector according to the modification. Identical reference signs are assigned to components identical to those in the embodiment described above, and duplicated explanation will be omitted.

As illustrated in FIG. 11 and FIG. 12, an actuator 3A of a connector 1A according to the modification includes side walls 31A having a shape different from the side walls 31 described above. As illustrated in FIG. 12, a base portion 311A of the side wall 31A includes a curved surface 311*d*A. The curved surface 311*d*A connects the second end surface 311*b* and the upper surface 311*a*. The base portion 311A does not have the second ridge 311*e* described above at an end portion of the curved surface 311*d*A. That is, the curved surface 311*d*A and the second end surface 311*b* are smoothly continuous. In this manner, the base portion 311A is not necessarily provided with the second ridge 311*e*. Even in such a case, the base portion 311A can be used for the inspection to determine whether the actuator 3 is properly closed.

REFERENCE SIGNS LIST

1, 1A CONNECTOR
2 INSULATOR
21 END WALL
23 REAR WALL
235 RECESSED PORTION
23*a* UPPER SURFACE
23*b* REAR SURFACE
23*c* FIRST MAIN SURFACE
23*f* FRONT SURFACE
3, 3A ACTUATOR
31, 31A SIDE WALL
311 BASE PORTION
311*a* UPPER SURFACE
311*b* SECOND END SURFACE
311*c* SECOND MAIN SURFACE
311*d* CURVED SURFACE
311*e* SECOND RIDGE
313 RECOGNITION PORTION
313*a* UPPER SURFACE
313*b* FIRST END SURFACE
313*e* FIRST RIDGE
315 RAISED PORTION
319 SHAFT
33 FIRST PLATE
34 SECOND PLATE
4 CONTACT
8 CABLE
81 LUG PORTION
9 SUBSTRATE

The invention claimed is:

1. A connector comprising:
an insulator that includes a first main surface being a surface that faces a cable, and a rear surface being a surface on an opposite side of the first main surface;
a contact that electrically connects the cable and a substrate; and
an actuator that is rotatable about a rotation axis parallel to the substrate, wherein
the actuator includes a plate-shaped side wall that intersects with the rotation axis,
the side wall includes: a base portion including a second main surface being a surface that faces the first main surface when the actuator is rotated in a direction closer to the cable; and a recognition portion that protrudes from the base portion, and
a distance from the rotation axis to a leading end of the recognition portion in a direction orthogonal to the second main surface is larger than a distance from the rotation axis to the rear surface.

2. The connector according to claim 1, wherein
the distance from the rotation axis to the leading end of the recognition portion in the direction orthogonal to the rotation axis and parallel to the second main surface is different from a distance from the rotation axis to an upper surface of the insulator in a direction orthogonal to the rotation axis and parallel to the rear surface.

3. The connector according to claim 1, wherein
the distance from the rotation axis to the leading end of the recognition portion in the direction orthogonal to the rotation axis and parallel to the second main surface is larger than a distance from the rotation axis to an upper surface of the insulator in a direction orthogonal to the rotation axis and parallel to the rear surface.

4. The connector according to claim 1, wherein
the recognition portion includes: a first end surface that is the farthest surface from the rotation axis in the direction orthogonal to the second main surface; and a first ridge that is positioned at an end portion of the first end surface.

5. The connector according to claim 1, wherein
the recognition portion includes an upper surface that is on an opposite side of the insulator and that has a planar shape.

6. The connector according to claim 1, wherein
the insulator includes a front surface that is the farthest surface from the rear surface,
the base portion includes a second end surface that is a surface positioned on an opposite side of the second main surface with respect to the rotation axis, and
a distance from the rotation axis to the second end surface in a direction orthogonal to the second main surface is larger than a distance from the rotation axis to the front surface.

7. The connector according to claim 6, wherein
the base portion includes a second ridge that is positioned at an end portion of the second end surface.

8. The connector according to claim 6, wherein
the base portion includes a curved surface that is continuous to the second end surface, and the curved surface forms an arc about the rotation axis when viewed from a direction parallel to the rotation axis.

* * * * *